US008459777B2

(12) United States Patent
Silverbrook et al.

(10) Patent No.: US 8,459,777 B2
(45) **Date of Patent: *Jun. 11, 2013**

(54) FEED MECHANISM FOR WIDE FORMAT PRINTER

(75) Inventors: Kia Silverbrook, Balmain (AU); Nagesh Ramachandra, Balmain (AU); Jan Waszczuk, Balmain (AU)

(73) Assignee: Zamtec Ltd, Dublin (IE)

( * ) Notice: Subject to any disclaimer, the term of this patent is extended or adjusted under 35 U.S.C. 154(b) by 778 days.

This patent is subject to a terminal disclaimer.

(21) Appl. No.: 12/646,737

(22) Filed: Dec. 23, 2009

(65) Prior Publication Data

US 2010/0104343 A1 Apr. 29, 2010

Related U.S. Application Data

(63) Continuation of application No. 11/223,262, filed on Sep. 12, 2005, now Pat. No. 7,695,204.

(51) Int. Cl.
*B41J 2/155* (2006.01)

(52) U.S. Cl.
USPC ..... 347/42; 347/101

(58) Field of Classification Search
USPC ..... 347/4, 5, 14, 15, 16, 19, 37–38, 40, 347/41, 101, 104, 139, 154
See application file for complete search history.

(56) References Cited

U.S. PATENT DOCUMENTS

| | | | |
|---|---|---|---|
| 4,046,074 | A | 9/1977 | Hochberg et al. |
| 4,422,590 | A | 12/1983 | Rathbone |
| 4,542,393 | A | 9/1985 | Hilpert et al. |
| 5,342,133 | A | 8/1994 | Canfield |
| 5,343,229 | A | 8/1994 | Ohshima |
| 5,433,539 | A | 7/1995 | German |
| 5,441,210 | A | 8/1995 | Hinton |
| 5,529,410 | A | 6/1996 | Hunter et al. |
| 5,547,298 | A | 8/1996 | Wouters et al. |
| 5,684,516 | A | 11/1997 | Cseledy et al. |
| 5,729,817 | A | 3/1998 | Raymond et al. |
| 5,751,303 | A | 5/1998 | Erickson et al. |
| 5,820,279 | A | 10/1998 | Lodwig et al. |
| 5,820,280 | A | 10/1998 | Fox |

(Continued)

FOREIGN PATENT DOCUMENTS

| | | | |
|---|---|---|---|
| JP | 08-002078 | A | 1/1996 |
| JP | 08-002821 | A | 1/1996 |

(Continued)

*Primary Examiner* — Thinh Nguyen
(74) *Attorney, Agent, or Firm* — Cooley LLP

(57) ABSTRACT

A feed mechanism for a wide format printer is provided having a supply spool for supplying media web to a printhead, a take-up spool for receiving the web after printing, a take-up motor connected to the take-up spool, a take-up control system for controlling the take-up motor torque, a drive roller system positioned between the supply and take-up spools, a drive motor connected to the drive roller system, and a braking motor connected to the supply spool for generating tension in the web between the supply spool and the drive roller system. The take-up, drive and braking motors are separate motors and are separately connected to the take-up spool, drive roller system and supply spool, respectively. The web fed from the drive roller system to the take-up spool is maintained under substantially constant tension by regulating the torque of the take-up motor using the take-up control system.

17 Claims, 4 Drawing Sheets

U.S. PATENT DOCUMENTS

| | | | | |
|---|---|---|---|---|
| 5,911,382 | A | 6/1999 | Wilson | |
| 6,234,606 | B1 | 5/2001 | Suzuki | |
| 6,334,723 | B1 | 1/2002 | Trovinger et al. | |
| 6,361,230 | B1 | 3/2002 | Crystal et al. | |
| 6,508,543 | B2 | 1/2003 | Hawkins et al. | |
| 6,641,314 | B2 | 11/2003 | Mogi | |
| 6,764,234 | B2 | 7/2004 | Ono et al. | |
| 6,789,869 | B2 * | 9/2004 | Takeishi | 347/16 |
| 6,799,913 | B2 | 10/2004 | Ono et al. | |
| 7,213,987 | B2 | 5/2007 | Manduley | |
| 2002/0071017 | A1 | 6/2002 | Pitpit et al. | |
| 2002/0126298 | A1 | 9/2002 | Galan et al. | |
| 2003/0194253 | A1 | 10/2003 | Trovinger | |
| 2005/0041050 | A1 | 2/2005 | Masuyama et al. | |

FOREIGN PATENT DOCUMENTS

| | | | |
|---|---|---|---|
| JP | 10-006486 | | 1/1998 |
| JP | 11-246095 | | 9/1999 |
| JP | 2000-006389 | | 1/2000 |
| JP | 2000-033720 | A | 2/2000 |
| JP | 2002-111962 | | 4/2002 |
| JP | 2004-090487 | | 3/2004 |
| JP | 2006-347640 | | 12/2006 |
| WO | WO 02/077108 | A | 10/2002 |

* cited by examiner

FEED MECHANISM FOR WIDE FORMAT PRINTER

CROSS REFERENCES TO RELATED APPLICATIONS

The present application is a Continuation of U.S. application Ser. No. 11/223,262 filed on Sep. 12, 2005, now issued U.S. Pat. No. 7,695,204.

FIELD OF THE INVENTION

This invention relates to wide format printers and improvements thereto for allowing high-speed pagewidth inkjet printing.

CO-PENDING APPLICATIONS

The following applications have been filed by the Applicant with the present application:

| | | | |
|---|---|---|---|
| 11/223,018 | 7,322,761 | 11/223,021 | 11/223,020 |

The disclosures of these co-pending applications are incorporated herein by reference.

CROSS REFERENCES TO RELATED APPLICATIONS

Various methods, systems and apparatus relating to the present invention are disclosed in the following co-pending applications filed by the applicant or assignee of the present invention. The disclosures of all of these co-pending applications and granted patents are incorporated herein by cross-reference.

| | | | | |
|---|---|---|---|---|
| 6,750,901 | 6,476,863 | 6,788,336 | 7,249,108 | 6,566,858 |
| 6,331,946 | 6,246,970 | 6,442,525 | 7,346,586 | 09/505,951 |
| 6,374,354 | 7,246,098 | 6,816,968 | 6,757,832 | 6,334,190 |
| 6,745,331 | 7,249,109 | 7,197,642 | 7,093,139 | 7,509,292 |
| 10/636,283 | 10/866,608 | 7,210,038 | 10/940,653 | 10/942,858 |
| 7,364,256 | 7,258,417 | 7,293,853 | 7,328,968 | 7,270,395 |
| 7,461,916 | 7,510,264 | 7,334,864 | 7,255,419 | 7,284,819 |
| 7,229,148 | 7,258,416 | 7,273,263 | 7,270,393 | 6,984,017 |
| 7,347,526 | 7,357,477 | 7,465,015 | 7,364,255 | 7,357,476 |
| 11/003,614 | 7,284,820 | 7,341,328 | 7,246,875 | 7,322,669 |
| 6,623,101 | 6,406,129 | 6,505,916 | 6,457,809 | 6,550,895 |
| 6,457,812 | 7,152,962 | 6,428,133 | 7,204,941 | 7,282,164 |
| 7,465,342 | 7,278,727 | 7,417,141 | 7,452,989 | 7,367,665 |
| 7,138,391 | 7,153,956 | 7,423,145 | 7,456,277 | 7,550,585 |
| 7,122,076 | 7,148,345 | 7,470,315 | 7,572,327 | 7,416,280 |
| 7,252,366 | 7,488,051 | 7,360,865 | 6,746,105 | 7,156,508 |
| 7,159,972 | 7,083,271 | 7,165,834 | 7,080,894 | 7,201,469 |
| 7,090,336 | 7,156,489 | 7,413,283 | 7,438,385 | 7,083,257 |
| 7,258,422 | 7,255,423 | 7,219,980 | 7,591,533 | 7,416,274 |
| 7,367,649 | 7,118,192 | 7,618,121 | 7,322,672 | 7,077,505 |
| 7,198,354 | 7,077,504 | 7,614,724 | 7,198,355 | 7,401,894 |
| 7,322,676 | 7,152,959 | 7,213,906 | 7,178,901 | 7,222,938 |
| 7,108,353 | 7,104,629 | 7,246,886 | 7,128,400 | 7,108,355 |
| 6,991,322 | 7,287,836 | 7,118,197 | 7,575,298 | 7,364,269 |
| 7,077,493 | 6,962,402 | 10/728,803 | 7,147,308 | 7,524,034 |
| 7,118,198 | 7,168,790 | 7,172,270 | 7,229,155 | 6,830,318 |
| 7,195,342 | 7,175,261 | 7,465,035 | 7,108,356 | 7,118,202 |
| 7,510,269 | 7,134,744 | 7,510,270 | 7,134,743 | 7,182,439 |
| 7,210,768 | 7,465,036 | 7,134,745 | 7,156,484 | 7,118,201 |
| 7,111,926 | 7,431,433 | 7,018,021 | 7,401,901 | 7,468,139 |
| 11/097,308 | 7,448,729 | 7,246,876 | 7,431,431 | 7,419,249 |
| 7,377,623 | 7,334,876 | 09/575,197 | 7,079,712 | 6,825,945 |
| 7,330,974 | 6,813,039 | 6,987,506 | 7,038,797 | 6,980,318 |

-continued

| | | | | |
|---|---|---|---|---|
| 6,816,274 | 7,102,772 | 7,350,236 | 6,681,045 | 6,728,000 |
| 7,173,722 | 7,088,459 | 09/575,181 | 7,068,382 | 6,789,194 |
| 6,789,191 | 6,644,642 | 6,502,614 | 6,622,999 | 6,669,385 |
| 6,549,935 | 6,727,996 | 6,591,884 | 6,439,706 | 6,760,119 |
| 7,295,332 | 6,290,349 | 6,428,155 | 6,785,016 | 6,870,966 |
| 6,822,639 | 6,737,591 | 7,055,739 | 7,233,320 | 6,830,196 |
| 6,832,717 | 6,957,768 | 7,456,820 | 7,170,499 | 7,106,888 |
| 7,123,239 | 10/727,181 | 10/727,162 | 7,377,608 | 7,399,043 |
| 7,121,639 | 7,165,824 | 7,152,942 | 10/727,157 | 7,181,572 |
| 7,096,137 | 7,302,592 | 7,278,034 | 7,188,282 | 7,592,829 |
| 10/727,180 | 10/727,179 | 10/727,192 | 10/727,274 | 10/727,164 |
| 7,523,111 | 7,573,301 | 10/727,158 | 10/754,536 | 10/754,938 |
| 10/727,160 | 7,369,270 | 6,795,215 | 7,070,098 | 7,154,638 |
| 6,805,419 | 6,859,289 | 6,977,751 | 6,398,332 | 6,394,573 |
| 6,622,923 | 6,747,760 | 6,921,144 | 10/884,881 | 7,092,112 |
| 7,192,106 | 7,457,001 | 7,173,739 | 6,986,560 | 7,008,033 |
| 7,551,324 | 7,195,328 | 7,182,422 | 7,374,266 | 7,427,117 |
| 7,448,707 | 7,281,330 | 10/854,503 | 7,328,956 | 10/854,509 |
| 7,188,928 | 7,093,989 | 7,377,609 | 7,600,843 | 10/854,498 |
| 10/854,511 | 7,390,071 | 10/854,525 | 10/854,526 | 7,549,715 |
| 7,252,353 | 7,607,757 | 7,267,417 | 10/854,505 | 7,517,036 |
| 7,275,805 | 7,314,261 | 7,281,777 | 7,290,852 | 7,484,831 |
| 10/854,523 | 10/854,527 | 7,549,718 | 10/854,520 | 7,631,190 |
| 7,557,941 | 10/854,499 | 10/854,501 | 7,266,661 | 7,243,193 |
| 10/854,518 | 10/934,628 | 7,448,734 | 7,425,050 | 7,364,263 |
| 7,201,468 | 7,360,868 | 7,234,802 | 7,303,255 | 7,287,846 |
| 7,156,511 | 10/760,264 | 7,258,432 | 7,097,291 | 10/760,222 |
| 10/760,248 | 7,083,273 | 7,367,647 | 7,374,355 | 7,441,880 |
| 7,547,092 | 10/760,206 | 7,513,598 | 10/760,270 | 7,198,352 |
| 7,364,264 | 7,303,251 | 7,201,470 | 7,121,655 | 7,293,861 |
| 7,232,208 | 7,328,985 | 7,344,232 | 7,083,272 | 7,621,620 |
| 11/014,763 | 7,331,663 | 7,360,861 | 7,328,973 | 7,427,121 |
| 7,407,262 | 7,303,252 | 7,249,822 | 7,537,309 | 7,311,382 |
| 7,360,860 | 7,364,257 | 7,390,075 | 7,350,896 | 7,429,096 |
| 7,384,135 | 7,331,660 | 7,416,287 | 7,488,052 | 7,322,684 |
| 7,322,685 | 7,311,381 | 7,270,405 | 7,303,268 | 7,470,007 |
| 7,399,072 | 7,393,076 | 11/014,750 | 7,588,301 | 7,249,833 |
| 7,524,016 | 7,490,927 | 7,331,661 | 7,524,043 | 7,300,140 |
| 7,357,492 | 7,357,493 | 7,566,106 | 7,380,902 | 7,284,816 |
| 7,284,845 | 7,255,430 | 7,390,080 | 7,328,984 | 7,350,913 |
| 7,322,671 | 7,380,910 | 7,431,424 | 7,470,006 | 7,585,054 |
| 7,347,534 | 7,441,865 | 7,469,989 | 7,367,650 | |

BACKGROUND OF THE INVENTION

Wide format printers are well known for printing large sized images onto a web of print media. They may be used, for example, in printing billboards or large office spreadsheets. Examples of popular wide format printers, which have been commercially available for many years, are the Hewlett Packard (HP) 1000/5000, the HP 3000/3500 and the Epson 7000/10 000.

All commercially available wide format printers have a moving printhead that traverses across a print medium whilst depositing ink. The print medium is necessarily stationary as the printhead traverses across it. When one line of an image has been printed the web incrementally advances ready for the next line to be printed.

An inherent disadvantage of current wide format printers is their slowness. High volume, high resolution printing is an objective that has been sought by the manufacturers of wide format printers for some time. Central to the problem of achieving high printing speeds is the ability to provide a printhead, which does not traverse across a stationary print medium and which is capable of generating the necessary number of ink dots at a suitable rate. Pagewidth printheads would avoid the need for a traversing printhead and allow high-speed printing. However, commercially available bubble jet and piezoelectric printheads suffer from excessive heat build up and energy consumption, and are therefore unsuitable for use in a pagewidth configuration. A number of disadvantages associated with such printheads are set out in U.S. Pat. No. 6,443,555.

The present Applicant has developed pagewidth printheads capable of producing images having a resolution as high as 1600 dpi. These printheads are manufactured using integrated circuit fabrication techniques. Details of these printheads are the subject of a number of granted US patents and pending US patent applications, which are listed in the cross reference section above.

The pagewidth printheads developed by the present Applicant are extremely suitable for use in wide format printers, because they can operate at high speeds and can be driven at an extremely high cyclical rate. Accordingly, the present Applicant has developed a wide format printer employing a pagewidth printhead. An example of such a wide format printer is described in U.S. Pat. No. 6,672,706 (Silverbrook), which is incorporated herein by reference. This printer makes high-speed wide format printing possible by "printing-on-the-fly"—that is, continuously feeding a web past the printhead and simultaneously printing without the web having to be stationary at any stage.

It will be appreciated that, in order to achieve "printing-on-the-fly" at high speed with consistent print quality, it is important that feeding of the web is finely controlled. Any variation in web speed or web tension will result in a deterioration in print quality in the form of, for example, a distorted image. Accordingly, it would be desirable to provide a feed mechanism which achieves substantially constant tension in a web as it passes a printhead.

It would be further desirable to avoid of slippage of the web relative to drive rollers in the feed mechanism in order to maintain a constant web speed. It would be further desirable to provide drive rollers having sufficient fraction with the web to avoid slippage, but which also maintain this traction after repeated uses of the feed mechanism over long periods of time.

It would be further desirable to provide a feed mechanism which minimizes folding, creasing or crumpling of the web before it reaches a printhead.

It will also be appreciated that, in order to achieve "printing-on-the-fly" at high speed with consistent print quality, it is important that a constant distance is maintained between the printhead and the web onto which the printhead prints. Usually, inkjet printing is performed by printing onto a web in a print zone, with the web being supported by a platen. However, with pagewidth printheads secured to a metal carrier frame, there is a tendency for the metal frame to sag across its width relative to the platen. This sagging causes variation in the distance between the printhead and the web across the width of the printhead, which results in a deterioration in print quality. Accordingly, it would be desirable to provide a printhead arrangement, which minimizes any variation in distance between the printhead and the web.

SUMMARY OF THE INVENTION

In a first aspect, there is provided a feed mechanism for a wide format printer, the feed mechanism comprising:

a supply spool;

a take-up spool;

a take-up motor operatively connected to the take-up spool;

a take-up control system for controlling the torque of the take-up motor;

a drive roller system positioned between the supply spool and the take-up spool; and a drive motor operatively connected to the drive roller system, wherein, in use, a web fed from the drive roller system to the take-up spool is maintained under substantially constant tension by regulating the torque of the take-up motor using the take-up control system.

In a second aspect, there is provided a method of printing onto a web of print media, wherein the web is continuously fed past a printhead at a substantially constant predetermined tension.

In a third aspect, there is provided a drive roller system for a wide format printer, the drive roller system comprising:

a first drive roller having a rigid gritted surface, the first drive roller being operatively connected to a drive motor; and a second drive roller having a flexible gripping surface grippingly engageable with the first drive roller, wherein, in use, the rigid gritted surface and the flexible gripping surface cooperate to grip a web fed therebetween.

In a fourth aspect, there is provided a feed mechanism for a wide format printer, the feed mechanism comprising:

a supply spool;

a take-up spool;

a take-up motor operatively connected to the take-up spool; and a drive roller system positioned between the supply spool and the take-up spool, wherein the drive roller system is as defined above.

In a fifth aspect, there is provided a method of printing onto a web of print media, wherein the web is continuously fed past a printhead at a substantially constant predetermined speed.

In a sixth aspect, there is provided drive roller system for a wide format printer, the drive roller system comprising:

a first drive roller operatively connected to a drive motor; and a second drive roller releasably grippingly engageable with the first drive roller, wherein, in use, the web is fed between the first and second drive rollers.

In a seventh aspect, there is provided a feed mechanism for a wide format printer, the feed mechanism comprising:

a supply spool;

a take-up spool;

a take-up motor operatively connected to the take-up spool; and a drive roller system positioned between the supply spool and the take-up spool, wherein the drive roller system is as defined above.

In an eighth aspect, there is provided a method of extending the lifetime of a drive roller in a drive roller system for a wide format printer comprising the steps of: (a) providing a pair of grippingly engageable drive rollers; and (b) moving one of the drive rollers from a grippingly engaged position to a disengaged position when the printer is not in use.

In a ninth aspect, there is provided a feed mechanism for a wide format printer, the feed mechanism comprising:

a supply spool;

a braking mechanism operatively connected to the supply spool;

a take-up spool;

a take-up motor operatively connected to the take-up spool; and a drive roller system positioned between the supply spool and the take-up spool, wherein, in use, the braking mechanism generates tension in a web fed from the supply spool to the drive roller system.

In a tenth aspect, there is provided a method of minimizing web crumpling in a wide format printer comprising the steps of: (a) continuously feeding a web of print media from a supply spool and past a printhead using a drive roller system; and (b) tensioning the web between the supply spool and the drive roller system.

In an eleventh aspect, there is provided a printer comprising:

a printhead having a corresponding print zone, the print zone being defined by a plane adjacent the printhead; and a feed mechanism for continuously feeding a web of print media through the print zone, wherein the web is unsupported in the print zone.

In a twelfth aspect, there is provided a method of printing onto a web of print media, wherein the web is continuously fed unsupported past a printhead.

In a thirteenth aspect, there is provided a printer comprising:

a printhead assembly, the printhead assembly comprising a printhead mounted on a printhead carrier; and a feed mechanism for continuously feeding a web of print media past the printhead, wherein the printhead assembly is positioned in the path of the web such that, in use, the web is tensioned around the printhead assembly.

In a fourteenth aspect, there is provided a method of printing onto a web of print media, wherein the web is continuously fed past a printhead mounted in a printhead assembly, the printhead assembly being positioned in the path of the web such that the web is tensioned around the printhead assembly.

In a fifteenth aspect, there is provided a printhead assembly for a wide format printer, the printhead assembly comprising:

a printhead carrier;

a printhead mounted on the carrier, the printhead having a print zone defined by a plane adjacent the printhead; and a guide for guiding a web through the print zone, the guide being connected to the carrier.

In a sixteenth aspect, there is provided a method of printing onto a web of print media, wherein the web is continuously guided under tension past a printhead by a guide, the guide forming part of a printhead assembly in which the printhead is mounted.

The feed mechanism may advantageously maintain constant tension in the web between the drive roller system and the take-up spool. In a wide format printer, the printhead is typically positioned immediately downstream of the drive rollers. When "printing-on-the-fly", it is especially important that the tension of the web is constant as it passes the printhead in the print zone. Any variation in web tension will result in stretching or shrinking of the web and, since the web is not stationary during printing, this would lead to distorted printed images. Hence, the present invention improves print quality in a high-speed wide format printer by maintaining constant tension in the web in the print zone.

Furthermore, the feed mechanism may advantageously minimize the risk of web crumpling by providing a braking mechanism for tensioning the web between the supply spool and the drive roller system. Without a braking mechanism, the supply spool would be free to rotate under the action of the drive roller system drawing the web therefrom. Free and uncontrolled rotation of the supply spool is usual in most commercially available wide format printers. However, in high-speed wide format printers, it has been found that free rotation of the supply spool is undesirable, because it results in a much greater propensity for the web to become crumpled or folded when it is fed at high speeds. The braking mechanism provides a counter-rotational force against the force of the drive roller system drawing the web from the supply spool and, hence, generates tension in the web. By generating tension in the web between the supply spool and the drive roller system, the likelihood of paper crumpling and, ultimately, printer malfunction, is reduced.

The drive roller system may advantageously maintain constant speed in the web between the drive roller system and the take-up spool by minimizing slippage of the web relative to the drive rollers. In a wide format printer, the printhead is typically positioned immediately downstream of the drive rollers. When "printing-on-the-fly", it is especially important that the speed of the web is constant as it passes the printhead in the print zone. By minimizing slippage of the web relative to the drive roller system, the present invention improves print quality in a high-speed wide format printer by maintaining constant speed of the web in the print zone.

Releasable gripping engagement of the second drive roller with the first drive roller advantageously allows the second drive roller to be released from gripping engagement when the printer is not in use, thereby extending the lifetime of the drive rollers. If the second drive roller (typically having a soft, flexible surface) is allowed to remain in gripping engagement with the first drive roller (typically having a hard surface) in a static position for long periods of time, then permanent deformation of the surface of the second drive roller may result. Such permanent deformation undesirably takes the form of "flat spots" on the surface of the second drive roller. These flat spots can cause uneven gripping engagement with the first drive roller, which potentially results in periodic slippage of the web as it is fed through the drive roller system. Slippage of the web when performing high-speed "printing-on-the-fly" is highly undesirable and leads to variable web speeds, which typically manifests in distorted printed images.

The printer may advantageously obviate the need for a platen. In prior art wide format printers, the web is supported by a platen in the print zone. The web typically rests on the platen whilst the printhead traverses across it depositing ink to form one line of an image. Hence, the distance from the printhead to the print zone is governed by the distance from the printhead to the platen.

The Applicant has found that with pagewidth wide format printers (typically having a pagewidth printhead of about 36 inches in length), there is a tendency for the distance between the printhead and the platen to vary across the width of the web. This problem is caused by two factors. Firstly, the printhead carrier, being formed from metal, experiences bowing (or sagging) in its middle portion due to the effect of gravity in this unsupported region. This bowing effect is transferred to the printhead mounted at the base of the carrier. Secondly, the platen, being formed from relatively thick metal and/or being supported across its length, does not experience the same bowing effect. The result is that the relative distance between the printhead and the platen is smaller in the middle region than it is at the end regions of the printhead. This variation is highly undesirable in terms of achieving consistently high print quality at high speeds.

In order to address this problem, the Applicant has devised a novel printer, wherein the web is unsupported in the print zone. An advantage of the web not being supported by a platen is that there is no possibility of variations in distance between the printhead and the platen (such as variations caused by bowing across the printhead carrier) affecting the critical distance between the printhead and the print zone.

Furthermore, the printhead assembly may be positioned in the path of the web such that the web is tensioned around the printhead assembly. An advantage of this arrangement is that the web is self-supporting as it passes the printhead and allows the distance between the printhead and the web to be controlled by surface features on the printhead assembly. Accordingly, the possibility of the distance between the printhead and the web varying due to bowing across the printhead carrier is minimized.

Furthermore, the printhead assembly may comprise a guide, which guides a web under tension through the print zone. The web is typically tensioned around the guide by a suitable feed mechanism. An advantage of this arrangement is that the web is self-supporting as it passes the printhead and allows the distance between the printhead and the web to be controlled by the guide, which is an integral part of the printhead assembly.

Optional Features of the Invention

The supply spool and take-up spool may be of any suitable type, generally having a spindle, which can accommodate a roll of print media, supported between a pair of end mountings. However, since the web is under tension in the present invention, it is preferred that the supply and take-up spools are designed to minimize any slippage of the web relative to spools. Furthermore, the supply and take-up spools should optionally allow facile loading and unloading of print media. The present Applicant has developed several supply and take-up spools suitable for use in the present invention and these are described in the following copending patent applications, filed concurrently with the present application.

| | | |
|---|---|---|
| WFP004 | WFP005 | WFP006 |

These copending patent applications are all incorporated herein by reference and are temporarily identified by the Applicant's docket numbers.

In the present invention, it is desired to maintain a constant predetermined tension in the web between the drive roller system and the take-up spool. Typically, the required tension is in the range of 20 to 100 N. Specifically, it has been found that a constant tension of about 60 N provides good print quality with the Applicant's preferred printhead arrangement (see below). However, the feed mechanism of the present invention can, of course, be used to provide any required tension in the web and maintain this tension at a constant level.

The take-up control system will typically be a computer system, which is able to vary the current in the take-up motor and, hence, vary the torque of the take-up motor in a controlled manner. It is necessary to regulate the torque of the take-up motor, because its radius increases as the web is wound on during printing. Torque is defined by the equation:

$$T=F\times r$$

where F is the tangential force and r is the radius of the spool.

Thus, in order to maintain a constant tension F in the web, it is necessary to increase the torque T in the take-up motor as the radius r of the take-up spool increases. The take-up control system, therefore, contains or receives information relating to the radius of the take-up spool and uses this information to regulate the torque of the take-up motor accordingly. For example, in one embodiment, the take-up control system may be programmed with information regarding the initial unloaded radius $r^1$ and the final loaded radius $r^2$ of the take-up spool for a particular print job. Each of $r^1$ and $r^2$ will have a corresponding torque $T^1$ and $T^2$, respectively, which is necessary to maintain a constant tension in the web. Accordingly, the take-up control system may be programmed to increase the take-up motor torque linearly from $T^1$ to $T^2$ over the duration of a particular print job. To a good approximation, this linear increase in torque will be sufficient to maintain a constant tension in the web.

Alternatively, the take-up motor may be fitted with an encoder, which provides data to the take-up control system regarding the speed of the take-up motor. If the take-up control system is programmed with data regarding the thickness of the web, it can calculate the exact radius of the take-up spool at any given moment during printing. Hence, in this alternative embodiment, the take-up control system can accurately control the take-up motor torque in response to dynamic information received from the encoder.

By contrast, it is preferred that the drive motor, which drives the drive roller system, maintains a constant speed under torque load. The drive motor controls the speed of the web as it passes the printhead and it is important the speed of the web, as well as the tension, in the web is constant to maintain good print quality. Optionally, the drive motor is a four-quadrant motor, which will be well known to the person skilled in the art.

Optionally, the drive roller system comprises:

a first drive roller operatively connected to the drive motor; and a second drive roller grippingly engaged with the first drive roller, wherein, in use, the web is fed between the first and second drive rollers.

Typically, the second roller is an idle roller without a corresponding motor. It is driven by virtue of being grippingly engaged with the first drive roller which is, in turn, driven by the drive motor. Optionally, the first drive roller is positioned below the second drive roller.

Optionally, the first drive roller has a hard, rigid gritted surface, whilst the second drive roller has a soft, flexible gripping surface. Typically, the first drive roller is formed from aluminium or steel having a machined or surface-treated outer surface. The outer surface of the first drive roller is a grit surface, which maximizes traction with the web in combination with the second drive roller. Typically, the second drive roller has an outer surface comprised of a soft, flexible gripping material. This gripping material may be plastics, rubber or another suitable material. The second drive roller may, for example, have a thick (e.g. 5 to 20 mm) layer of polyurethane around its outer surface, which can capture and grip the web in combination with the first drive roller.

Optionally, the first and second drive rollers are releasably grippingly engaged with each other. Releasable gripping engagement is preferred, because it is desirable to release the second drive roller from gripping engagement when the feed mechanism is not in use. If the second drive roller, having a soft, flexible surface, is allowed to remain in gripping engagement with the first drive roller, having a hard surface, in a static position for long periods of time, then permanent deformation of the surface of the second drive roller may result. Such permanent deformation undesirably takes the form of "flat spots" on the surface of the second drive roller. These flat spots can cause uneven gripping engagement with the first drive roller, which potentially results in periodic slippage of the web as it is fed through the drive roller system. As already discussed, slippage of the web when performing high-speed "printing-on-the-fly" is highly undesirable and typically manifests in distorted printed images.

Optionally, the second drive roller is moveable between an operational position, in which it is grippingly engaged with the first drive roller, and an idle position, in which it disengaged (i.e. spaced apart) from the first drive roller. Such movement of the second drive roller may be either manually or automatically performed. Optionally, the feed mechanism includes a suitable automated mechanism for moving the second drive roller to its idle position during idle periods. Optionally, the drive roller system comprises a solenoid (e.g. a latching solenoid) coupled to the second drive roller for automatically moving it from the operational position to the idle position when the feed mechanism is not in use, thereby minimizing permanent deformation of the flexible surface of the second drive roller. The skilled person will be able to envisage a number of suitable solenoid arrangements for automatically disengaging the second drive roller from the first drive roller.

Typically, the feed mechanism also includes an idle roller positioned between the drive roller system and the take-up spool. The idle roller allows the feed mechanism to adopt a convenient upright configuration with the supply and take-up spools being easily accessible by the user.

Optionally, the supply spool is operatively connected to a braking mechanism for generating tension in the web between the supply spool and the drive roller system. The braking mechanism may take the form of a friction brake acting against rotation of the supply spool. Optionally, the braking mechanism takes the form of a braking motor connected to the supply spool. The braking motor may be connected by means of a gear wheel at one end of the supply spool, which engages with a complementary gear wheel on the motor.

Without a braking mechanism, the supply spool would be free to rotate under the action of the drive roller system drawing the web therefrom. Free and uncontrolled rotation of the supply spool is usual in most commercially available wide format printers. However, in high-speed wide format printers, it has been found that free rotation of the supply spool is undesirable, because it results in a much greater propensity for the web to become crumpled or folded when it is fed at high speeds. The braking mechanism provides a counter-rotational force against the force of the drive roller system drawing the web from the supply spool and, hence, generates tension in the web. By generating tension in the web between the supply spool and the drive roller system, the likelihood of paper crumpling and, ultimately, printer malfunction, is reduced.

In practice, it has been found that a relatively small amount of tension in the web between the supply spool and the drive roller system is sufficient to minimize paper crumpling. Typically, the braking mechanism is required to generate about 1 to 10 N of tension in the web, optionally about 5 N. In contrast to the take-up side of the drive rollers described above, it is not critical that the tension on the supply side is kept absolutely constant. Small variations in tension due to a decreasing radius of the supply spool can be accommodated without adversely affecting the operation of the feed mechanism or printer.

The feed mechanism of the present invention is specifically adapted for use in a wide format printer. Accordingly, a wide format printer is also provided having a pagewidth printhead positioned so that the printhead prints onto a web of print media being fed past it by the feed mechanism.

The printhead is optionally positioned downstream of the drive rollers. By "downstream", it is meant the take-up side of the drive rollers, which is maintained at constant tension in the present invention. Since the take-up side of the drive rollers is under a relatively high tension (e.g. 60 N), the printhead is optionally positioned proximal to the drive rollers in order to minimize the effect of any stretching between the drive rollers and the printhead.

The "print zone" is defined by a plane adjacent (and parallel to) the printhead onto which the printhead prints. In use, the web is typically fed continuously through the print zone, which is at a predetermined distance below the printhead. The distance from the printhead to the print zone is critical to maintain good print quality. In the preferred embodiment, this distance is from 0.2 to 1.5 mm, optionally 0.5 to 0.9 mm or optionally about 0.7 mm. Any variation, even a small variation, in the distance of the print zone from the printhead results in a deterioration in print quality, which is highly undesirable.

Generally, the printhead forms part of a printhead assembly. The printhead assembly typically comprises the printhead mounted at the base of a printhead carrier. Typically, the printhead carrier is in the form of a metal frame, which also houses ink delivery systems, associated electronics for the printhead, and other printhead support components.

Optionally, the printhead is a pagewidth inkjet printhead. Examples of suitable pagewidth printheads may be found in the patents and patent applications cross-referenced herein.

In prior art wide format printers, the web is supported by a platen in the print zone. The web typically rests on the platen whilst the printhead traverses across it depositing ink to form one line of an image. Hence, the distance from the printhead to the print zone is governed by the distance from the printhead to the platen.

The Applicant has found that with pagewidth wide format printers (typically having a pagewidth printhead of about 36 inches in length), there is a tendency for the distance between the printhead and the platen to vary across the width of the web. This problem is caused by two factors. Firstly, the printhead carrier, being formed from metal, experiences bowing (or sagging) in its middle portion due to the effect of gravity in this unsupported region. This bowing effect is transferred to the printhead mounted at the base of the carrier. Secondly, the platen, being formed from relatively thick metal and/or being supported across its length, does not experience the same bowing effect. The result is that the relative distance between the printhead and the platen is smaller in the middle region than it is at the end regions of the printhead. As discussed above, this variation is highly undesirable in terms of achieving consistently high print quality at high speeds.

In order to address this problem, the Applicant has devised a novel printer, wherein the web is unsupported in the print zone. The feed mechanism described above, which provides a constant high tension on the take-up side of the drive roller system, is highly suitable for use in this printer. An advantage of the web not being supported by a platen is that there is no possibility of variations in distance between the printhead and the platen (such as variations caused by bowing across the printhead carrier) affecting the critical distance between the printhead and the print zone.

Optionally, the web is self-supporting in the print zone by virtue of tension in the web generated by the feed mechanism and, in particular, the take-up motor. Optionally, the printhead carrier comprises a guide for guiding the web through the print zone. In use, the printhead assembly is optionally positioned in the path of the web such that the web is tensioned around the guide. An advantage of this arrangement is that the guide forms part of the printhead carrier. Therefore, with the web tensioned around the guide, any bowing across the printhead carrier is generally replicated in the guide. The result is that a substantially constant distance between the printhead and the web is maintained, irrespective of any bowing or sagging across the printhead carrier.

BRIEF DESCRIPTION OF DRAWINGS

A specific form of the invention will now be described in detail, with reference to the following drawings, in which:—

DETAILED DESCRIPTION OF A SPECIFIC EMBODIMENT

Figure 1:
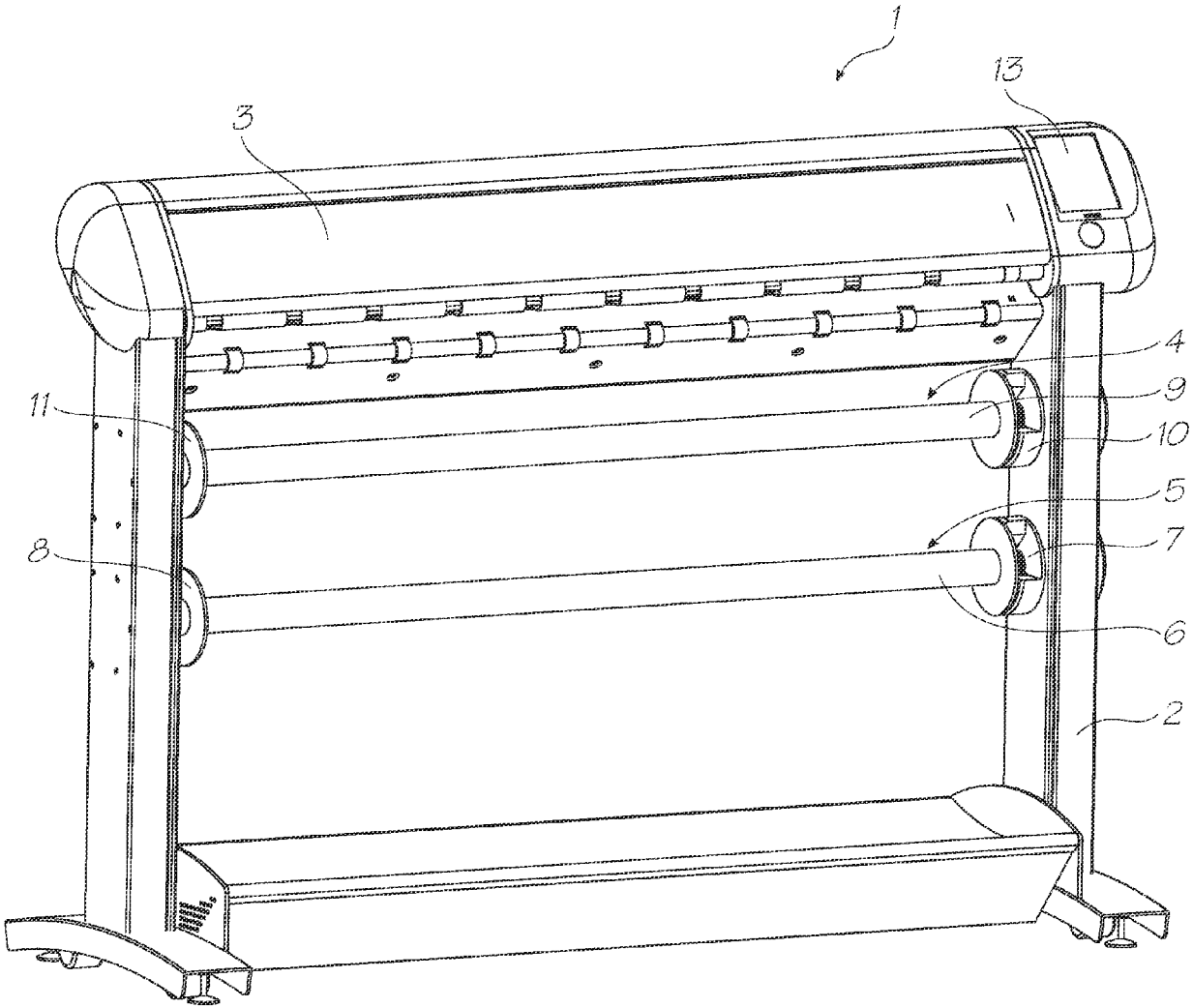
FIG. 1 is a perspective view of a wide format printer according to the invention.

Referring to FIG. 1, there is shown a wide format printer 1 comprising a frame 2, which supports a print engine 3, a supply spool 4 and a take-up spool 5.

The supply spool 4 takes the form of a spindle 6 mounted between a pair of end mountings 7 and 8, which are each supported by the frame 2. The supply spool 4 rotates relative to the frame 2 by virtue of bearings (not shown) in the end mountings 7 and 8. The supply spool 4 is positioned relatively proximal to the print engine 3, in order to minimize the risk of web crumpling. Rolls of print media (not shown) may be conveniently loaded onto the supply spool 4 by the user.

Likewise, the take-up spool 5 takes the form of a spindle 9 mounted between a pair of end mountings 10 and 11, which are each supported by the frame 2. The take-up spool rotates relative to the frame 2 by virtue of bearings (not shown) in the end mountings 10 and 11. The take-up spool receives a web of print media (not shown) after an image has been printed onto the web in the print engine 3. The printed web is wound around the take-up spool 5, from where it can be unloaded by the user. The take-up spool is positioned relatively distal from the print engine 3 in order to maximize ink drying time.

The printer 1 includes a control panel 13, which provides a user interface with the printer. The control panel 13 takes the form of a touch-sensitive screen with menu options for controlling various printing parameters.

Figure 2:
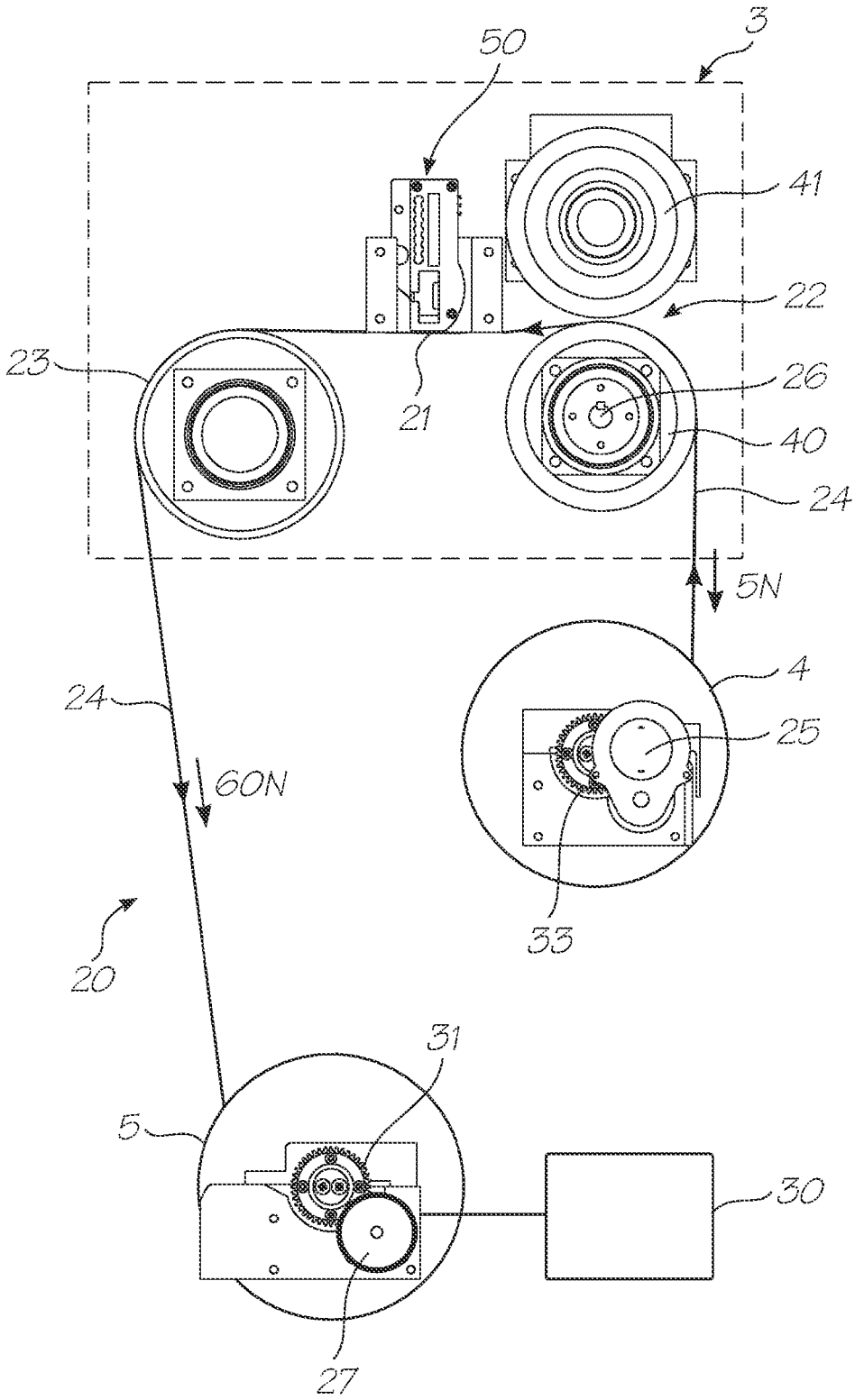
FIG. 2 is a schematic side view of a feed mechanism according to the invention with a printhead assembly.

The major components of the print engine 3 are shown in the boxed section of FIG. 2. The print engine 3 comprises a printhead 21, a drive roller system 22 and an idle roller 23. The drive roller system 22 and the idle roller 23 form part of the feed mechanism 20, which is described in more detail below.

Feed Mechanism

Referring to FIG. 2, the feed mechanism 20 continuously feeds a web 24 past the printhead 21 under constant speed and tension when the printer 1 is operating. In this specific embodiment, the feed mechanism comprises a supply spool 4 having a corresponding braking motor 25, a drive roller system 22 having a corresponding drive motor 26, an idle roller 23, a take-up spool 5 having a corresponding take-up motor 27, and a take-up control system 30.

The drive roller system 22 is positioned between the supply spool 4 and the take-up spool 5, with the drive motor 26 being responsible for providing the main drive for the feed mechanism 20. The braking motor 25 is responsible for controlling tension in the web 24 on the supply side of the drive roller system 22. The take-up motor 27, in combination with the take-up control system 30, is responsible for controlling tension in the web 24 on the take-up side of the drive roller system 22.

The idle roller 23 is positioned between the drive roller system 22 and the take-up spool 5 in the print engine 3. The idle roller 23 does not affect the tension in the web 24; it merely provides a directional change in the web 24, thereby allowing the printer 1 to have a generally upright configuration with the supply spool 4 and take-up spool 5 positioned conveniently and accessibly below the print engine 3.

Take-Up Spool

Referring to FIG. 2, the take-up spool 5 comprises a corresponding gear wheel 31, which connects it to the take-up motor 27. The take-up motor 27 is controlled by the take-up control system 30, which controls the current in the take-up motor and, therefore, controls the take-up motor torque. The take-up motor torque is controlled to provide a constant tension of about 60 N in the web 24 between the take-up spool 5 and the drive roller system 22. A tension of about 60 N has been found to be optimal for the preferred printhead arrangement described in more detail below.

Due to the increasing radius of the take-up spool 5, as the web 24 is wound on, the take-up motor torque needs to be continuously increased to compensate for this increase in radius and maintain a constant tension of 60 N in the web In one embodiment, the take-up control system 30 is programmed with data regarding the initial radius $r^1$ and final radius $r^2$ of the take-up spool 5. These initial and final radii correspond to an initial torque $T^1$ and final torque $T^2$, which are necessary to maintain a tension of 60 N in the web 24. During a print job, the take-up control system 30 increases the take-up motor torque linearly from $T^1$ to $T^2$. This linear increase in torque ensures, at least to a very good approximation, that a constant tension is maintained in the web 24 between the take-up spool 5 and the drive roller system 22 throughout the duration of the print job.

Figure 3:
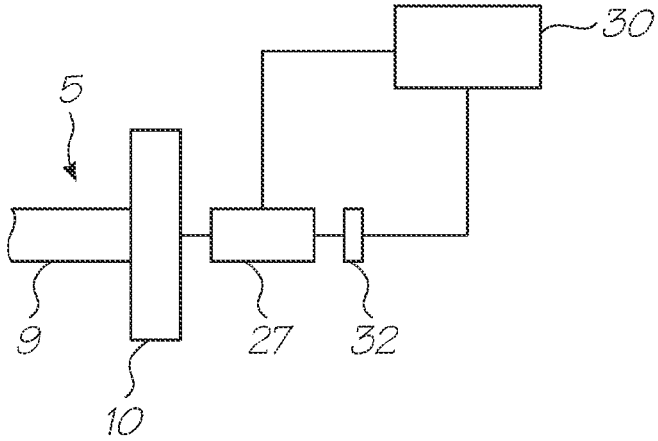
FIG. 3 is a schematic view of the take-up spool, take-up motor, take-up control system and encoder.

In an alternative embodiment, shown in FIG. 3, the take-up motor 27 is fitted with an encoder 32. The encoder 32 is configured to determine the speed of the take-up motor 27 during a print job. Data regarding the speed of the take-up motor 27 is fed from the encoder 32 to the take-up control system 30, which allows the take-up control system to calculate the number of revolutions completed by the take-up motor. The take-up control system 30 is programmed with data regarding the thickness of the web 24. Therefore, the take-up control system can calculate the radius of the take-up spool 5 at any given time using the data received from the encoder 32 in combination with its programmed data regarding the thickness of the web 24. Using this calculated radius, the take-up control system 30 can vary the take-up motor torque during a print job so as to maintain a constant tension of 60 N in the web 24 between the take-up spool 5 and the drive motor system 22.

Drive Roller System

Figure 4:
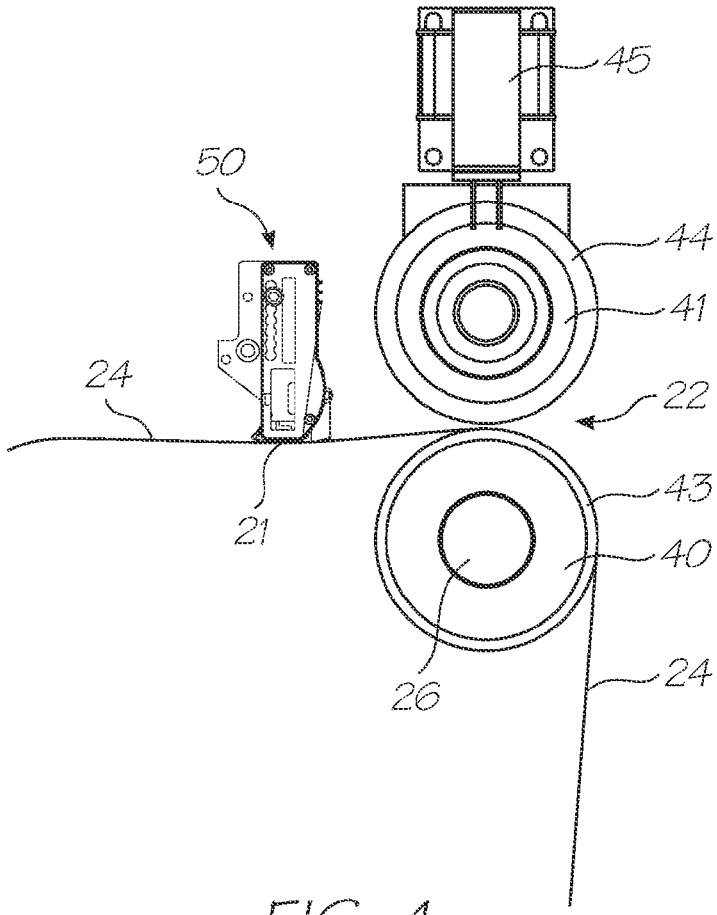
FIG. 4 is a schematic side view of the drive roller system and printhead assembly.

The drive roller system 22 is located in the print engine 3 and provides the main drive for the feed mechanism 20. Referring to FIG. 4, the drive roller system 22 comprises a pair of rollers, one positioned on top of the other. A lower drive roller 40 is operatively connected to a drive motor 26 and an upper drive roller 41 is grippingly engaged with the lower drive roller. The upper drive roller 41 is essentially idle and is driven by virtue of its gripping engagement with the lower drive roller 40. The web 24 is fed from the supply spool 4, between the lower and upper drive rollers 40 and 41, and towards the printhead 21.

The drive motor 26 is a four-quadrant motor, which maintains a constant speed under torque load. The drive motor 26 controls the speed of the web 24 as it exits the drive roller system 22 and passes the printhead 21. The drive motor 26 experiences a torque load from the tension in the web 24 and maintains a constant rotational speed under this load. Hence, the speed of the web 24 as it passes the printhead 21 is constant, irrespective of the tension in the web.

Since the web 24 is tensioned on either side of the drive roller system 22, it is important that the web does not slip relative to the pair of drive rollers 40 and 41 so as to maintain a constant web speed. Accordingly, the surfaces of the drive rollers 40 and 41 are configured to maximize fraction with the web 24 in a complementary fashion. The lower drive roller 40 is formed from aluminium having a hard, gritted surface 43. The upper drive roller 41 has a thick polyurethane surface 44. These two surfaces cooperate to grip firmly the web 24 fed between the pair of rollers 40 and 41, thereby minimizing slippage.

During printing, it is important that the upper drive roller 41 is grippingly engaged with the lower drive roller 40 in order to maximize traction with the web 24. However, when the printer 1 is not in use, a region of the polyurethane surface 44 on the upper drive roller 41 can become permanently deformed by being compressed against the lower drive roller 40. When the drive rollers 40 and 41 are not rotating, a static compression force against the upper drive roller 41 can cause "flat spots" on the soft polyurethane surface 44.

Accordingly, the upper drive roller 41 is releasably grippingly engageable with the lower drive roller 40, having both an operational position in which it is grippingly engaged with the lower drive roller 40 and an idle position in which it is disengaged from the lower drive roller 40. To facilitate releasable gripping engagement, the drive roller system 22 includes a latching solenoid 45 coupled to the upper drive roller 41, which is configured to disengage the upper drive roller from the lower drive roller 40. The latching solenoid 45 automatically moves the upper drive roller 41 upwards relative to the lower drive roller 40 when the printer 1 is not in use. Hence, during idle periods, the polyurethane surface 44 does not experience a permanent compression force from the hard surface 43 of the lower drive roller 40.

Supply Spool

Referring to FIG. 2, the supply spool 4 comprises a corresponding gear wheel 33, which connects it to the braking motor 25. The braking motor 25 acts on the supply spool 4 to provide tension in the web 24 between the drive motor system 22 and the supply spool. Hence, the braking motor 25 provides resistance to free rotation of the supply spool 4, which is caused by the drive roller system 22 drawing the web 24 from the supply spool.

The braking motor 25 is configured to provide a web tension of about 5 N, which is generally sufficient to minimize folding or crumpling of the web 24 before it reaches the drive roller system 22. This tension may increase as the web 24 is fed from the supply spool 4 and the radius of the supply spool decreases under constant braking motor torque. However, in contrast to the take-up side of the feed mechanism 20, it is not critical that the web tension on the supply side is maintained absolutely constant throughout the duration of each print job.

Printhead Assembly

Referring to FIG. 2, a printhead assembly 50 is located in the print engine 3 and positioned between the drive roller system 22 and the idle roller 23. The printhead assembly 50 is positioned proximal to and downstream of the drive roller system 22 in order to minimize any variations in web speed as the web 24 passes the printhead 21.

Figure 5:
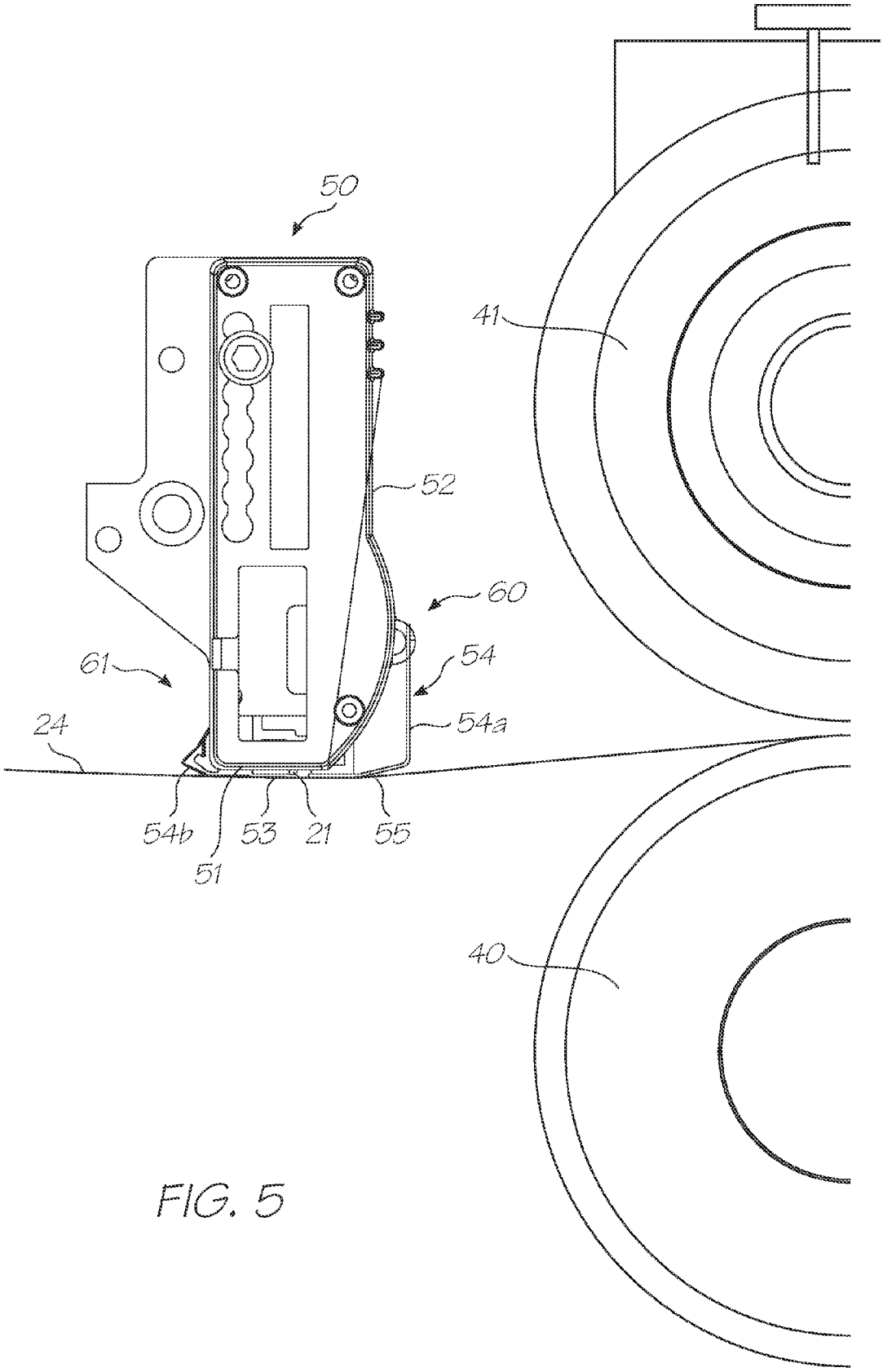
FIG. 5 is a schematic side view of the printhead assembly.

Referring to FIG. 5, the printhead assembly 50 comprises a pagewidth printhead 21 mounted at the base 51 of a carrier frame 52. The pagewidth printhead 21 may be any one of the printheads described in the cross-referenced patents and patent applications.

The carrier frame 52 also houses support systems for the printhead 21, such as ink delivery systems and associated electronic drive circuitry (not shown).

A print zone 53 is defined by a plane parallel to the plane of the printhead 21 and located 0.7 mm below the printhead. The web 24 is fed continuously through the print zone 53 during a print job. In order to maintain a constant distance between the pagewidth printhead 21 and the web 24 across the entire printhead, the web is not supported by a platen in the print zone 53, as is the case in conventional wide format printers. Instead, the web 24 is self-supporting in the print zone by virtue of the 60 N tension generated in the web by the take-up motor 27.

A guide 54 is fixed to the carrier frame 52 and forms an integral part of the printhead assembly 50. The guide 54 comprises two parts: an approach guide 54*a* and an exit guide 54*b*, both parts being configured to guide the web 24 through the print zone 53 located below the printhead 21. The approach guide 54*a* is fixed to a front side 60 of the printhead assembly 50 and curves underneath the base 51 of the carrier frame 52, terminating upstream of the print zone 53. The exit guide 54*b* is fixed to a back side 61 of the printhead assembly and curves underneath the base 51 of the carrier frame 52, terminating downstream of the print zone 53.

The web 24 is tensioned around the guide 54 and follows a path defined by its smooth lower surface, formed from polished steel. As shown in FIG. 5, the approach guide 54*a* has a leading angular edge 55 which abuts with the approaching web 24, such that the natural path of the web is deflected downwards and around the guide.

The guide 54, which forms an integral part of the printhead assembly 50, generally replicates any bowing across the base 51 of the carrier frame 52. Hence, the guide 54 assists in maintaining a constant distance between the printhead 21 and the web 24, irrespective of any bowing across the base 51 of the carrier frame 52.

It will, of course, be appreciated that a specific embodiment of the present invention has been described purely by way of example, and that modifications of detail may be made within the scope of the invention, which is defined by the accompanying claims.

The invention claimed is:

1. A feed mechanism for a wide format printer, the feed mechanism comprising:

a supply spool for supplying a web of print media to a printhead;

a take-up spool for receiving the web after printing by said printhead;

a take-up motor connected to the take-up spool;

a take-up control system for controlling the torque of the take-up motor;

a drive roller system positioned between the supply and take-up spools;

a drive motor connected to the drive roller system; and a braking motor connected to the supply spool for generating tension in the web between the supply spool and the drive roller system, the take-up, drive and braking motors being separate motors and being separately connected to the take-up spool, drive roller system and supply spool, respectively, wherein, in use, the web fed from the drive roller system to the take-up spool is maintained under substantially constant tension by regulating the torque of the take-up motor using the take-up control system.

2. The feed mechanism of claim 1, wherein the take-up control system increases the torque of the take-up motor as the radius of the take-up spool increases, thereby maintaining a substantially constant tension in the web between the take-up spool and the drive roller system.

3. The feed mechanism of claim 2, wherein the take-up control system maintains a predetermined tension in the web between the take-up spool and the drive roller system.

4. The feed mechanism of claim 3, wherein the predetermined tension is in the range of 20 to 100 N.

5. The feed mechanism of claim 4, wherein the predetermined tension is about 60 N.

6. The feed mechanism of claim 2, wherein the take-up spool has:

an initial unloaded radius of $r^1$ corresponding to an initial torque of $T^1$; and a final loaded radius of $r^2$ corresponding to a final torque of $T^2$, wherein the torque of the take-up motor is increased linearly from $T^1$ to $T^2$ during a print job.

7. The feed mechanism of claim 2, wherein the take-up motor comprises an encoder for providing data to the take-up spool control system regarding the speed of the take-up motor.

8. The feed mechanism of claim 7, wherein the take-up control system is programmed with data regarding the thickness of the web and uses data received from the encoder to calculate the radius of the take-up spool during printing.

9. The feed mechanism of claim 8, wherein the take-up control system increases the torque of the take-up motor accordingly as the calculated radius of the take-up spool increases, thereby maintaining a substantially constant tension in the web between the take-up spool and the drive roller system.

10. The feed mechanism of claim 1, wherein the drive motor maintains a constant speed under torque load.

11. The feed mechanism of claim 1, wherein the drive motor is a four-quadrant motor.

12. The feed mechanism of claim 1, wherein the drive roller system comprises:

a first drive roller operatively connected to the drive motor; and a second drive roller grippingly engageable with the first drive roller, wherein, in use, the web is fed between the first and second drive rollers.

13. The feed mechanism of claim 12, wherein the first drive roller has a rigid gritted surface and the second drive roller has a flexible gripping surface, the surfaces cooperating in use to grip a web fed therebetween.

14. The feed mechanism of claim 13, wherein the first and second drive rollers are releasably grippingly engageable.

15. The feed mechanism of claim 14, wherein the second drive roller is moveable between an operational position in which it is grippingly engaged with the first roller and an idle position in which it is disengaged from the first roller.

16. The feed mechanism of claim 15 further comprising a solenoid coupled to the second drive roller for automatically moving the second drive roller from the operational position to the idle position when the feed mechanism is not in use, thereby minimizing permanent deformation of the flexible surface of the second drive roller.

17. A wide format printer comprising:

a feed mechanism as defined in claim 1; and a printhead operatively positioned relative to the feed mechanism.

* * * * *